US012759741B2

(12) United States Patent
Frangella

(10) Patent No.: US 12,759,741 B2
(45) Date of Patent: Oct. 13, 2026

(54) ASSEMBLY FOR FOLDING AND HEAT-SEALING AT LEAST ONE FLAP OF PACKAGING SHEETS JUXTAPOSED AGAINST SURFACES OF A PRODUCT

(71) Applicant: SACMI PACKAGING & CHOCOLATE S.P.A., Imola (IT)

(72) Inventor: Gianni Frangella, Imola (IT)

(73) Assignee: SACMI PACKAGING & CHOCOLATE S.P.A., Imola (IT)

( * ) Notice: Subject to any disclaimer, the term of this patent is extended or adjusted under 35 U.S.C. 154(b) by 0 days.

(21) Appl. No.: 19/100,627

(22) PCT Filed: Jul. 31, 2023

(86) PCT No.: PCT/EP2023/071138
§ 371 (c)(1),
(2) Date: Feb. 3, 2025

(87) PCT Pub. No.: WO2024/028257
PCT Pub. Date: Feb. 8, 2024

(65) Prior Publication Data

US 2026/0035112 A1 Feb. 5, 2026

(30) Foreign Application Priority Data

Aug. 3, 2022 (IT) ..... 102022000016491

(51) Int. Cl.
*B65B 49/04* (2006.01)
*B65B 11/12* (2006.01)
(Continued)

(52) U.S. Cl.
CPC ..... *B65B 11/12* (2013.01); *B65B 11/48* (2013.01); *B65B 49/08* (2013.01); *B65B 51/14* (2013.01)

(58) Field of Classification Search
CPC ..... B65B 11/10; B65B 11/12; B65B 11/20; B65B 11/22; B65B 11/26; B65B 11/48
See application file for complete search history.

(56) References Cited

U.S. PATENT DOCUMENTS 1,454,279 A * 5/1923 Hayes ..... B65B 11/10 53/228
1,677,924 A * 7/1928 Metcalf ..... B65B 11/12 53/232
(Continued)

FOREIGN PATENT DOCUMENTS

DE 632205 C 7/1936
DE 1586015 A1 5/1970
(Continued)

OTHER PUBLICATIONS

International Search Report dated Dec. 15, 2023 issued in PCT/EP2023/071138.
(Continued)

*Primary Examiner* — Joshua G Kotis
*Assistant Examiner* — David G Shutty
(74) *Attorney, Agent, or Firm* — Scully, Scott, Murphy & Presser, P.C.

(57) ABSTRACT

An assembly for folding and heat-sealing at least one tubular portion constituted by flaps of packaging sheets which protrude with respect to opposite fronts of a product arranged on a conveyance line, comprises: a folding station provided with at least one folding plate having a width that is smaller than that of the product and of the tubular portion and at least one folding bar; at least one heat-sealing block, of shape and dimensions that are complementary to those of the lateral end of the tubular portion and movable between a passive configuration, in which it is spaced apart from the lateral end, and an active configuration, in which it abuts against the lateral end, following a release of the lateral end
(Continued)

by the folding bar; at least one heat-sealing plate, arranged downstream of the folding station along the conveyance line.

9 Claims, 3 Drawing Sheets

(51) Int. Cl.

| | |
|---|---|
| ***B65B 11/22*** | (2006.01) |
| ***B65B 11/48*** | (2006.01) |
| ***B65B 49/08*** | (2006.01) |
| ***B65B 51/14*** | (2006.01) |

(56) References Cited

U.S. PATENT DOCUMENTS

| | | | | | |
|---|---|---|---|---|---|
| 2,486,892 | A | * | 11/1949 | Ace | B65B 11/12 53/370.7 |
| 2,555,758 | A | * | 6/1951 | Webley | B65B 11/12 53/550 |
| 2,783,600 | A | * | 3/1957 | Olson | B65B 11/12 53/372.5 |
| 3,237,364 | A | * | 3/1966 | Mack | B65B 11/12 53/526 |
| 3,753,331 | A | * | 8/1973 | Sato | B65B 11/12 53/526 |
| 4,426,825 | A | * | 1/1984 | Nordstrom | B65B 11/12 198/723 |
| 4,624,096 | A | * | 11/1986 | Nordstrom | B65B 51/16 53/590 |

FOREIGN PATENT DOCUMENTS

| | | | | | |
|---|---|---|---|---|---|
| DE | 102020107432 | A1 | | 9/2020 | |
| GB | 402052 | A | * | 11/1933 | B65B 59/003 |
| GB | 1069649 | A | * | 5/1967 | B65B 11/12 |
| GB | 1113692 | A | * | 5/1968 | B65B 11/12 |
| IT | 970666 | A1 | | 5/1999 | |
| JP | H0692313 | A | | 4/1994 | |

OTHER PUBLICATIONS

Written Opinion dated Dec. 15, 2023 issued in PCT/EP2023/071138.

Italian Search Report and Written Opinion dated Apr. 6, 2023 issued in IT 202200016491, with partial translation.

* cited by examiner

ASSEMBLY FOR FOLDING AND HEAT-SEALING AT LEAST ONE FLAP OF PACKAGING SHEETS JUXTAPOSED AGAINST SURFACES OF A PRODUCT

BACKGROUND OF THE DISCLOSURE

The present invention relates to an assembly for folding and heat-sealing at least one flap of packaging sheets juxtaposed against surfaces of a product. The assembly that is the subject matter of the present invention can be used in a machine for packaging substantially flat products, in particular chocolate tablets or bars, snacks, chocolates, candy, biscuits, wafers and the like, although the possibility is not ruled out of also using it on products that are shaped differently.

For various types of products, a form of packaging is adapted which is constituted by a primary, wrapping layer (in direct contact with the surfaces of the product) and a secondary, covering layer (generally, but not exclusively, made of paper or cardboard).

The primary layer is generally made with sheets of aluminum (or sheets constituted by aluminum and other materials), although recently the increasing use has been seen of polymeric and/or biopolymeric sheets (more generally sheets of biodegradable and/or compostable materials and/or materials with similar characteristics).

This first, wrapping layer is juxtaposed against all the walls of the product and therefore covers it without modifying its space occupation.

By using sheets of aluminum (or sheets comprising aluminum), it is possible to take advantage of the mechanical characteristics of this material, which ensure that the sheet, once shaped, does not undergo elastic return. The tendency to maintain the shape that has been imposed on them, a property of sheets of aluminum (or sheets comprising aluminum), also makes it possible to manage, in a substantially simple manner, the heat-sealing operations of the flaps of such sheets in order to seal the product inside the sheet.

By contrast, by using sheets of other materials (in the group indicated above, such as for example polymeric and/or biopolymeric sheets), the risk of an elastic return determines the need to structure the packaging assemblies so as to combat this phenomenon.

Furthermore, the heat-sealing units present in the assembly must be designed (or at least adjusted/calibrated) as a function of the characteristics of the sheet used, since different materials require different operating temperatures and different compacting pressures of the flaps to be heat-sealed, and all extending over different time intervals.

Nowadays no assemblies are known for folding and heat-sealing the flaps of a primary covering sheet which are sufficiently versatile to be used indifferently (without making modifications to them or adding/removing components) with covering sheets of aluminum (or sheets comprising aluminum) and with sheets of polymeric and/or biopolymeric material.

In any case, the packaging speeds required in conventional packaging machines (and therefore the associated productivity) rule out the use of versatile assemblies, favoring assemblies dedicated to a specific wrapping sheet (which permit higher operating speeds as long as one specific type of wrapping sheet is exclusively used).

For folding the lateral strips of a primary wrapping, the use is known of folding units that impress the desired shape and, after being moved away, their place is taken by respective heat-sealing units that seal the flaps in that arrangement.

This technical embodiment is excellent with primary wrappings of aluminum (or which comprise aluminum) because this material tends to maintain the shape imposed on it by folding units. With primary wrappings made from sheets of polymeric-based or biopolymeric-based material, however, as soon as the folding units move away from the folded flaps, this material tends to elastically return to a substantially intermediate arrangement between the folded arrangement and the initial arrangement, so complicating (or impeding) the closure action of the heat-sealing units (which as a result will abut against the wrong portions of material, and therefore will not be in a position to perform a correct heat-sealing). Even if the heat-sealing is performed in a complete manner, the imperfect arrangement of the wrapping sheet could still result in the formation of wrinkles and creases on it, which would compromise its appearance.

BRIEF SUMMARY OF THE DISCLOSURE

The aim of the present invention is to solve the above-mentioned drawbacks, by providing an assembly for folding and heat-sealing at least one flap of packaging sheets juxtaposed against surfaces of a product that is adapted to operate on any type of wrapping sheet.

Within this aim, an object of the invention is to provide an assembly for folding and heat-sealing at least one flap of packaging sheets juxtaposed against surfaces of a product at a high operating speed.

Another object of the invention is to provide an assembly for folding and heat-sealing at least one flap of packaging sheets juxtaposed against surfaces of a product which can be installed in conventional packaging plants downstream of a station for wrapping the product with the wrapping sheet.

Another object of the invention is to provide an assembly for folding and heat-sealing at least one flap of packaging sheets juxtaposed against surfaces of a product that ensures a closure of the primary wrapping around a product that is free from defects.

Another object of the invention is to provide an assembly for folding and heat-sealing at least one flap of packaging sheets juxtaposed against surfaces of a product that ensures a closure of the primary wrapping that is stable.

Another object of the present invention is to provide an assembly for folding and heat-sealing at least one flap of packaging sheets juxtaposed against surfaces of a product which is of low cost, easily and practically implemented and safe in use.

This aim and these and other objects that will become more apparent hereinafter are achieved by an assembly for folding and heat-sealing at least one flap of packaging sheets juxtaposed against surfaces of a product, in particular of at least one tubular portion constituted by flaps of packaging sheets which protrude with respect to opposite fronts of the product arranged on a conveyance line, characterized in that it comprises:

- a folding station provided with at least one folding plate which can slide along a plane that faces and is proximate to the plane that contains a front of said product from which said tubular portion of flaps of packaging sheets protrudes, said plate having a width that is smaller than that of said product and of said tubular portion, and with at least one folding bar which can slide along a lateral wall of said folding plate in order to abut against a respective lateral end of said tubular portion and fold it;
- at least one heat-sealing block, of shape and dimensions that are complementary to those of said lateral end of said tubular portion and movable between a passive configuration, in which it is spaced apart from said lateral end, and an active configuration, in which it abuts against said lateral end, following the release of said lateral end by said folding bar;

at least one heat-sealing plate, arranged downstream of said folding station along said conveyance line.

Further characteristics and advantages of the invention will become better apparent from the detailed description that follows of a preferred, but not exclusive, embodiment of the assembly for folding and heat-sealing at least one flap of packaging sheets juxtaposed against surfaces of a product, which is illustrated by way of non-limiting example in the accompanying drawings wherein:

DETAILED DESCRIPTION OF THE DISCLOSURE

Figure 1:
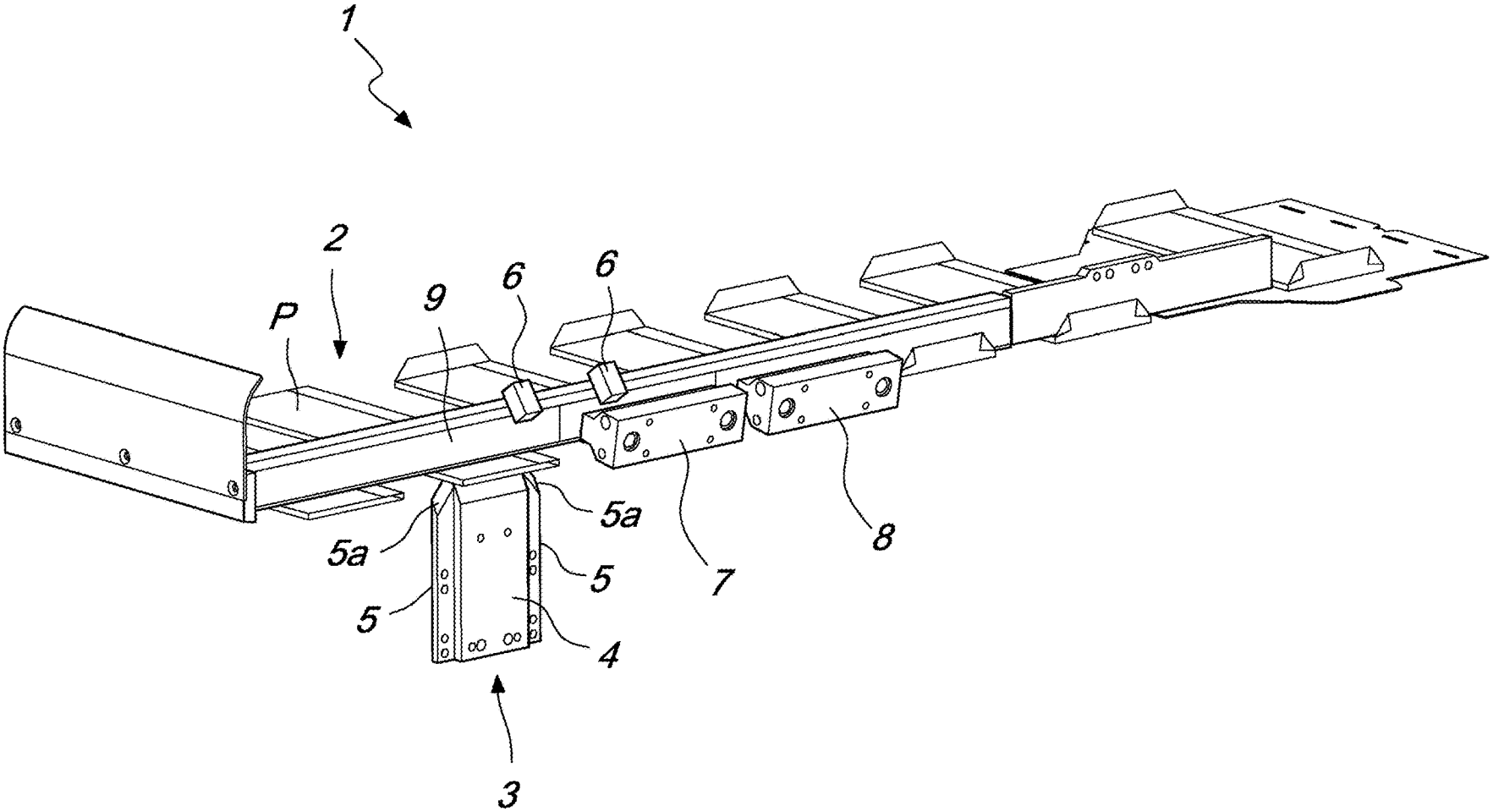
FIG. 1 is a schematic perspective view of an embodiment of a portion of a packaging plant that comprises the assembly for folding and heat-sealing at least one flap of packaging sheets juxtaposed against surfaces of a product according to the invention.

With reference to the figures, the reference numeral 1 generally designates an assembly for folding and heat-sealing at least one flap of packaging sheets A juxtaposed against surfaces of a product P.

The assembly 1 according to the invention is specifically indicated for folding and heat-sealing the at least one tubular portion B constituted by flaps of packaging sheets A which protrude with respect to opposite fronts of the product P, when the product is arranged on a conveyance line 2.

The assembly 1 according to the invention comprises a folding station 3 provided with at least one folding plate 4 which can slide along a plane that faces and is proximate to the plane containing a front of the product P from which the tubular portion B of the flaps of packaging sheets A protrudes.

According to the invention, the plate 4 can advantageously have a width that is smaller than the width of the product P and of the tubular portion B.

Figure 3:
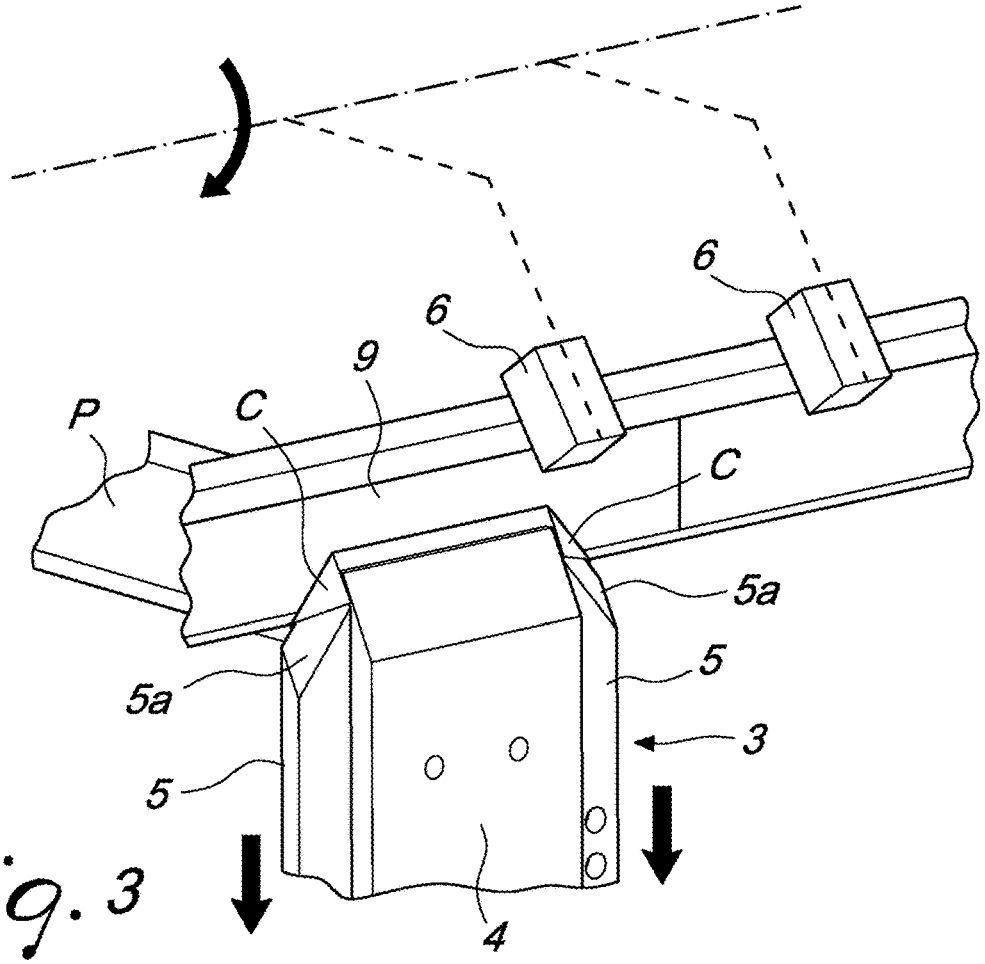
FIG. 3 is a schematic perspective view of a second step of folding performed by the assembly according to the invention.

The folding station 3 will furthermore conveniently be provided with at least one folding bar 5, which can slide along a corresponding lateral wall of the folding plate 4, in order to abut against a respective lateral end of the tubular portion B and fold it (as illustrated by way of non-limiting example in the accompanying FIG. 3).

Figure 4:
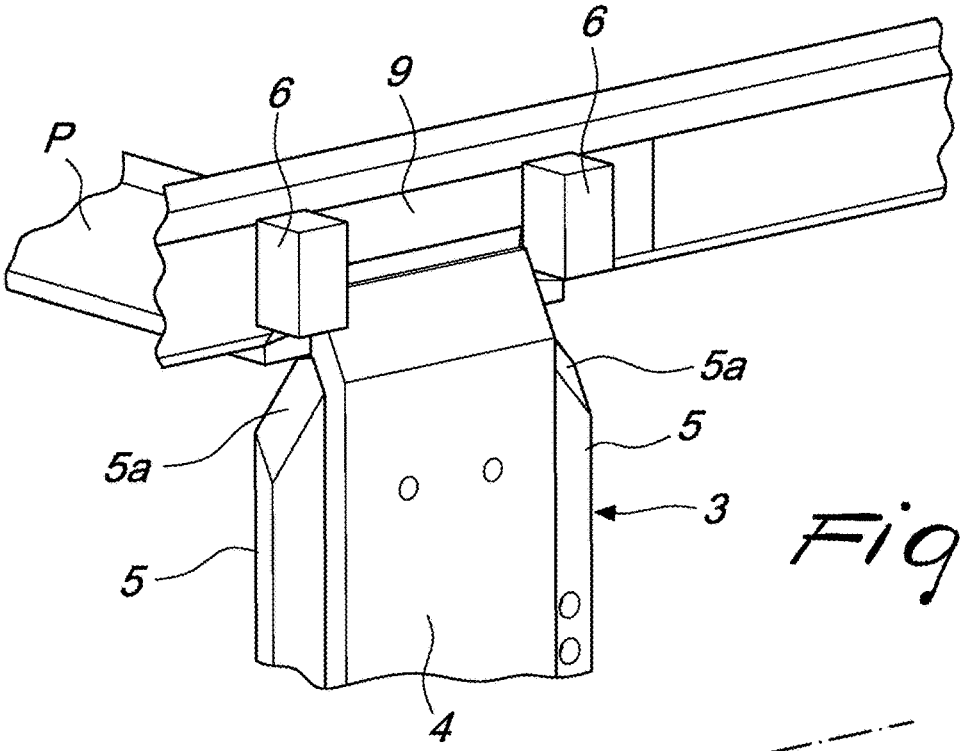
FIG. 4 is a schematic perspective view of a first step of heat-sealing performed by the assembly according to the invention.
Figure 5:
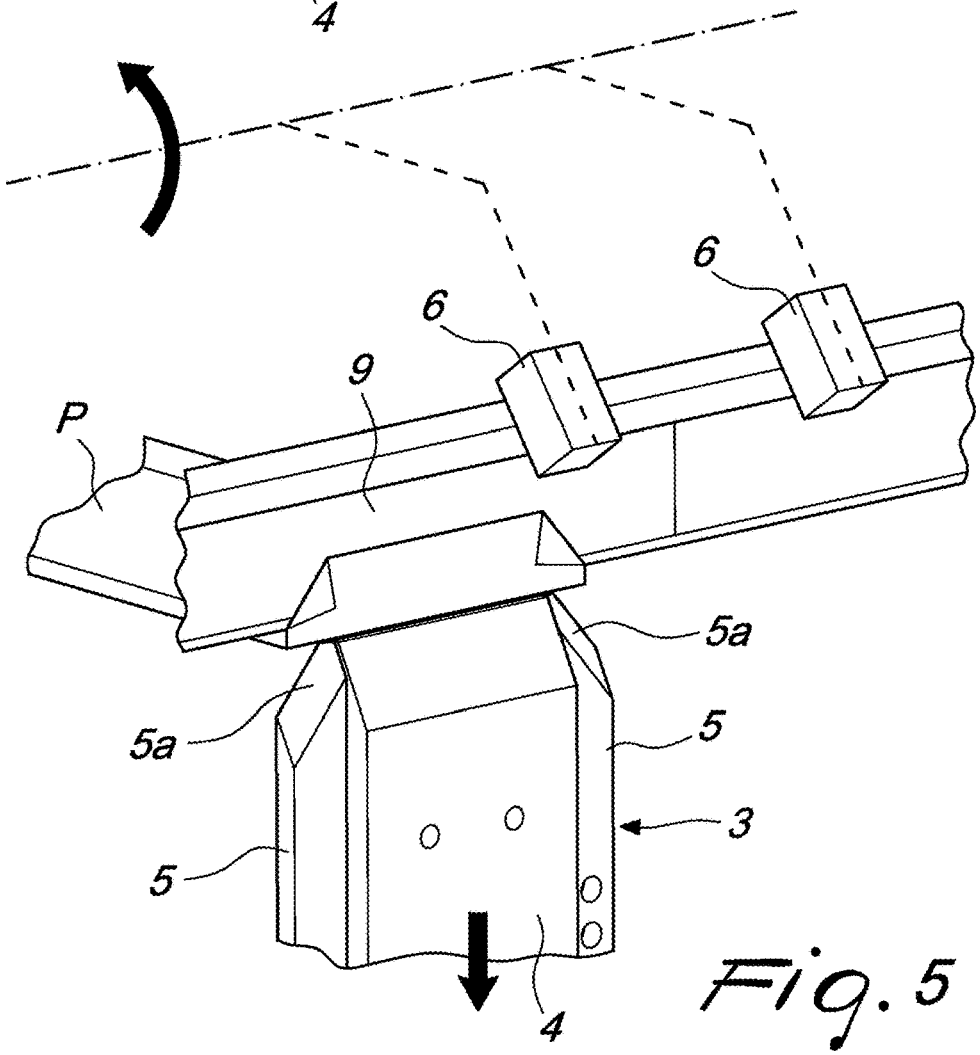
FIG. 5 is a schematic perspective view of a step of releasing the flap of packaging sheets for subsequent transfer to successive heat-sealing plates of the assembly according to the invention.

The assembly 1 according to the invention advantageously comprises at least one heat-sealing block 6, of shape and dimensions that are complementary to those of the lateral end of the tubular portion B and movable between a passive configuration, in which it is spaced apart from the lateral end, and an active configuration, in which it abuts against the lateral end. The transition of the at least one heat-sealing block 6 from the passive configuration to the active configuration only occurs following the release of the lateral end by the respective folding bar 5 (as illustrated by way of non-limiting example in the accompanying FIG. 4).

The assembly 1 according to the invention profitably also comprises at least one heat-sealing plate 7, 8, arranged downstream of the folding station 3 along the conveyance line 2.

It should be noted that the folding station 3 can positively comprise two separate folding bars 5, which can slide along respective mutually opposite lateral walls of the folding plate 4 in order to abut against respective lateral ends of the tubular portion B and fold them.

With particular reference to the embodiment just illustrated, the heat-sealing blocks 6 will therefore be two in number, and both can move between a passive configuration, in which they are spaced apart from a respective lateral end of the tubular portion B, and an active configuration, in which they abut against it (in order to heat-seal it in the folded arrangement).

The blocks 6 will conveniently be configured to reach the active configuration following the release of the lateral ends of the tubular portion B by the respective folding bar 5.

With particular reference to an embodiment of undoubted practical and applicative interest, the at least one folding bar 5 can positively comprise a wedge-shaped terminal end 5*a*, which is adapted to abut against a corresponding tubular portion B of the packaging sheets A that protrudes from mutually opposite fronts of each product P: the terminal end 5*a* will present its apex (i.e. the sharp end of its wedge-shaped part) in a position contiguous to the lateral wall of the folding plate 4 with respect to which the bar 5 (with the end 5*a*) can slide.

This shape structure of the terminal end 5*a* of each bar 5 is designed to perform an optimal folding of the respective lateral end of the tubular portion B.

In fact, in a first step of folding, it will be the folding plate that acts on the tubular portion B, folding it and making the two flaps of the sheet A that constitutes it fit together (but leaving the two lateral ends of that portion B free).

At this point it will be the folding bars 5 that will come into contact with the respective lateral ends of the tubular portion B: their wedge-shaped end 5*a* will first come into contact with the part of the lateral end of the tubular portion B that is close to the edge of the folding plate 4 and then, progressively, they will affect the remaining part of that end (the movement of each bar 5 will mean that a progressively increasing thickness of the respective wedge-shaped end 5*a* will be superimposed on the lateral end of the portion B). This type of folding makes it possible to minimize the risk of formation of wrinkles in the sheet A (which could induce tearing) and will result in the formation of a strip C of sheet A that will be superimposed on the surface of the terminal end 5*a* of each bar 5.

It will be precisely against this strip C (generated by the movement and by the wedge shape of the at least one bar 5) that the heat-sealing blocks 5 will abut in order to reach the engagement, so as to ensure that the portion B retains the folded arrangement even after the plate 4 has been moved away from it.

With particular reference to an embodiment of undoubted practical and applicative interest, the heat-sealing plates 7, 8 can conveniently be two in number, arranged in succession along the conveyance line 2.

It must be noted that the product A will advance along the conveyance line 2 by predefined steps interleaved with respective pauses.

The heat-sealing plates 7 and 8 will profitably be aligned with areas of the conveyance line 2 that are designed to accommodate the product during a respective pause: during the pause it will then be possible to perform the heat-sealing of the conveniently folded tubular portion B.

Having two heat-sealing plates 7, 8 arranged in series is extremely advantageous in it is possible to make the packaging plant (and therefore also the assembly 1 comprised in it) operate at extremely high speed: the duration of the pause of the product A at each heat-sealing plate 7, 8 in fact must not be sufficient to ensure the execution of a perfect heat-sealing, since there will be two consecutive heat-sealing operations, one after the other (and therefore the overall heat-sealing time will correspond to double the time of a single pause, so making it possible to minimize the duration of those pauses).

It should further be noted that the conveyance line 2 can advantageously comprise at least one lateral band 9 for abutment against at least one component chosen among the at least one folding plate 4, the at least one folding bar 5, the at least one heat-sealing block 6 and the at least one heat-sealing plate 7, 9.

The at least one heat-sealing plate 7, 9 therefore will usefully be able to move between a passive configuration, in which it faces and is proximate to the lateral abutment band 9 of the conveyance line 2, and an active configuration, in which its heat-sealing surface, kept at a predefined temperature, is forced onto the abutment band 9, with the interposition of the tubular portion B, which was previously folded by the folding station 3 and partially heat-sealed by means of the blocks 6.

At least one component chosen among the at least one folding plate 4, the at least one folding bar 5, the at least one heat-sealing block 6 and the at least one heat-sealing plate 7, 9 will be functionally associated with a respective controlled motor (and therefore actuated by it). The term "controlled motor" is defined as any motor, such as a brushless motor, a servomotor and the like.

This at least one controlled motor will advantageously be controlled by a respective control and management unit. By means of the control and management unit it will be possible to set (and adjust) the rule of motion of each motor, therefore making it possible top manage each movement of the components controlled by these motors by means of a respective parametrization of the theoretical cam of reference. This results in the possibility of adjusting every single operating parameter of the assembly 1 according to the invention, with the consequence of being able to maintain the ideal heat-sealing conditions even at varying speeds of the plant that comprises the assembly 1 (which, indeed, can be adapted rapidly to any change in the operating speed).

The assembly 1 according to the invention makes it possible to complete the closure of the primary wrapping (i.e. the wrapping designed to cover the product P and which comes into contact with the surfaces of the product P) by way of folding and heat-sealing the tubular portions B of wrapping that exceed the length of the product P.

The folding and heat-sealing operations, even if they need to be performed on a polymeric-based or biopolymeric-based sheet A of wrapping (despite the fact that such materials are characterized by a persistent shape memory) will be simple and can be performed even at extremely high speeds (with production rates of the order of 250 products per minute, although even higher speeds are not ruled out).

The operation of the assembly is the following.

Figure 2:
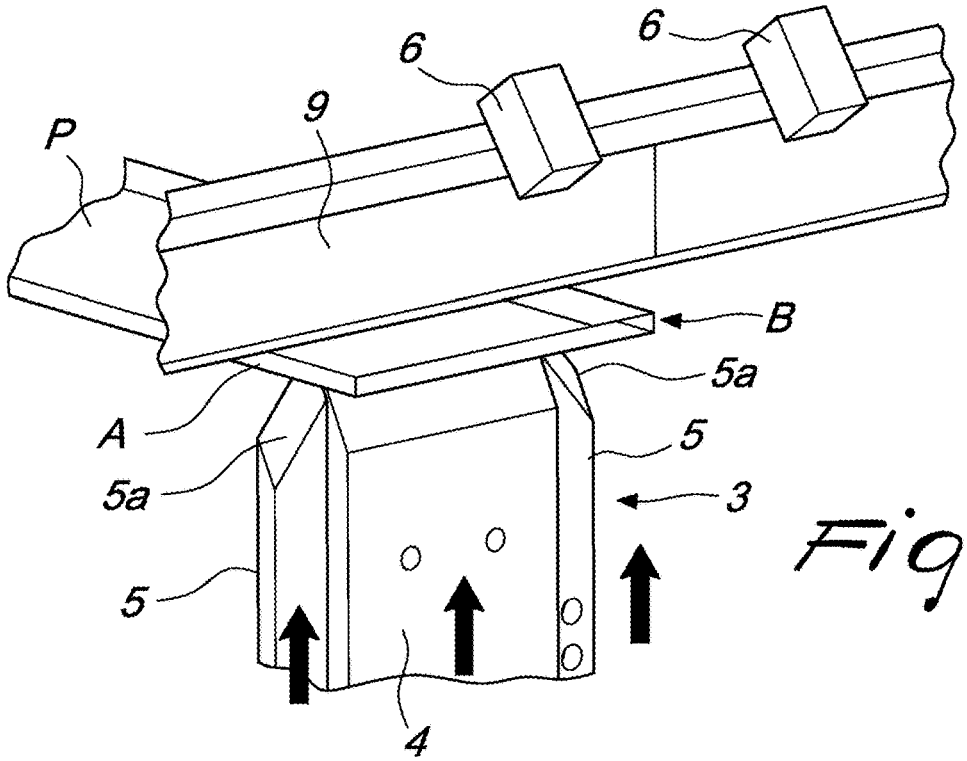
FIG. 2 is a schematic perspective view of a first step of folding performed by the assembly according to the invention.

During a first cycle, of folding (shown by way of non-limiting example in the accompanying FIGS. 2 and 3), the folding plate 4 and the folding bars 5 are proximate to the tubular portion A and they begin their functional stroke which will result in their performing the lateral fold, using the fixed abutment band 9 of the conveyance line 2.

In a subsequent second cycle, the lateral bars 5, which behave like lateral folding units, will be disengaged and the heat-sealing blocks 6 will heat-seal the folded strips C (arranged at the two sides of each tubular portion B). The lateral bars 5 will descend while the plate 4 remains in the folded position, so ensuring that the portion B is held in the folded arrangement. When the lateral bars 5 are out of the way, the heat-sealing blocks will be able to abut against the folded strips C, which will be unobstructed and accessible.

In a subsequent third cycle, the heat-sealing will be performed through the heat-sealing plates 7, 8 which will carry out the transverse heat-sealing of the folded portion B. The presence of two heat-sealing plates 7, 8 in sequence, as previously illustrated, makes it possible to minimize the pause time envisaged for the heat-sealing operation performed by each one of them. The possibility is not excluded of having an even larger number of heat-sealing plates arranged in succession along the conveyance line 2 (if the high operating speed of the plant makes this measure necessary).

A last operating cycle entails the disengagement of all the components of the assembly 1 from the fully-packaged product in order to transfer it to subsequent processing stations of the packaging plant.

All the operations described are conducted symmetrically on the two fronts of the product P, which comprise respective tubular portions B constituted by flaps of a sheet A that protrude beyond the length of the product P. Although different embodiments are not ruled out, it should be noted that in a preferred embodiment the operations of folding and heat-sealing the portion A are performed simultaneously on the two sides of the product P.

It is emphasized again that by comprising a first step of heat-sealing for positioning, carried out by virtue of the heat-sealing blocks 6, and providing for the presence of two heat-sealing plates 7, 8, components which are actuated completely independently of each other, it is possible to obtain many functional advantages.

In particular, under the same conditions it is possible to halve, with respect to the known art, the pressure and temperature values, by subjecting the sheet 1 to lower levels of stress (a widely-felt need when working with delicate and thin materials).

At high production speeds (for example 250 products per minute) the conditions will still be favorable for heat-sealing even the most difficult material, without resorting to excessive temperatures and/or pressures.

By virtue of the introduction of parametrized cams (i.e. the management and command logic of the controlled motors that constitute the actuators of all the components described), it will be possible to maintain the optimal heat-sealing setup (constant time and constant temperature) as the speed of the packaging plant varies. In machines according to the known art (of the exclusively mechanical type), maintaining the same heat-sealing conditions as the speed varies, represents a difficult management problem.

The present invention also extends its protection to include a plant for covering products P by means of packaging sheets A, which comprises a conveyance line 2 for the products P and at least one supply line of sheets A, and in which the conveyance line 2 is operated on by an apparatus for wrapping and closing at least one sheet A in a tube on each product P.

The plant according to the invention will furthermore usefully comprise, downstream of the apparatus for wrapping the product P, at least one assembly 1 for folding and heat-sealing at least one tubular portion B which is constituted by flaps of packaging sheets A which protrude with respect to opposite fronts of the product P, of the type illustrated previously.

Advantageously the present invention solves the above-mentioned problems, by providing an assembly 1 for folding and heat-sealing at least one flap of packaging sheets A juxtaposed against surfaces of a product P, which is adapted to operate on any type of wrapping sheet A (therefore both with sheets A constituted by or comprising aluminum, and with polymeric and/or biopolymeric sheets A).

Conveniently the assembly 1 according to the invention is adapted to operate at a high operating speed (even of the order of 250 products per minute, although the possibility is not ruled out of adopting even higher speeds).

Advantageously the assembly 1 according to the invention can be installed in conventional packaging plants downstream of a station for wrapping the product with the wrapping sheet A: the assembly 1 is therefore particularly versatile and adaptable to the packaging of any product P with any type of sheet A. In particular the assembly 1 is indicated for the primary packaging of bars of chocolate, snacks, small food items, food bars and the like (although the possibility is not ruled out of applying the assembly 1 according to the invention in the packaging of products P of different type).

Profitably the assembly 1 according to the invention ensures a closure of the primary wrapping around a product that is completely free from defects.

Advantageously the assembly 1 according to the invention ensures a closure of the primary wrapping that is extremely stable.

Positively the assembly 1 according to the invention is relatively easily and practically implemented and is of low cost: such characteristics make the assembly 1 according to the invention an innovation that is safe in use.

The invention thus conceived is susceptible of numerous modifications and variations, all of which are within the scope of the appended claims. Moreover, all the details may be substituted by other, technically equivalent elements.

In the embodiments illustrated, individual characteristics shown in relation to specific examples may in reality be interchanged with other, different characteristics, existing in other embodiments.

In practice, the materials employed, as well as the dimensions, may be any according to requirements and to the state of the art.

The disclosures in Italian Patent Application No. 102022000016491 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

The invention claimed is:

1. An assembly for folding and heat-sealing at least one flap of packaging sheets juxtaposed against surfaces of at least one tubular portion constituted by flaps of packaging sheets which protrude with respect to opposite fronts of a product arranged on a conveyance line, comprising:

a folding station provided with at least one folding plate which can slide along a plane that faces and is proximate to a plane that contains a front of said product from which said flaps of packaging sheets of said at least one tubular portion protrude, said at least one folding plate having a width that is smaller than that of said product and of said at least one tubular portion, and with at least one folding bar which can slide along a lateral wall of said at least one folding plate in order to abut against a respective lateral end of said at least one tubular portion and fold said lateral end;

at least one heat-sealing block, of shape and dimensions that are complementary to those of said lateral end of said at least one tubular portion and movable between a passive configuration, in which the at least one heat-sealing block is spaced apart from said lateral end, and an active configuration, in which the at least one heat-sealing block abuts against said lateral end, following a release of said lateral end by said at least one folding bar;

at least one heat-sealing plate, arranged downstream of said folding station along said conveyance line.

2. The assembly according to claim 1, wherein said at least one folding bar comprises two folding bars which can slide along respective mutually opposite lateral walls of said at least one folding plate in order to abut against respective lateral ends of said at least one tubular portion and fold said lateral ends.

3. The assembly according to claim 2, wherein said at least one heat-sealing block are two in number wherein said heat-sealing blocks can move between a passive configuration, in which said heat-sealing blocks are spaced apart from a respective lateral end of said at least one tubular portion, and an active configuration, in which said heat-sealing blocks abut against said lateral end, said heat-sealing blocks being configured to reach said active configuration following the release of said lateral end by said folding bar.

4. The assembly according to claim 1, wherein said at least one folding bar comprises a terminal end, which is adapted to abut against said at least one tubular portion constituted by flaps of packaging sheets which protrudes from mutually opposite fronts of each product, which is shaped like a wedge and a vertex of which is directed toward and is contiguous with the lateral wall of said at least one plate with respect to which said folding bar can slide.

5. The assembly according to claim 4, wherein said product advances along said conveyance line by predefined steps interleaved with respective pauses, said heat-sealing plates being aligned with areas of said conveyance line that are designed to accommodate said product during a respective pause.

6. The assembly according to claim 1, wherein said at least one heat-sealing plate comprises two heat-sealing plates in number wherein the heat-sealing plates are arranged along said conveyance line in succession.

7. The assembly according to claim 1, wherein said conveyance line comprises at least one lateral abutment band for at least one component chosen among said at least one folding plate, said at least one folding bar, said at least one heat-sealing block, and said at least one heat-sealing plate.

8. The assembly according to claim 7, wherein said at least one heat-sealing plate can move between a passive configuration, in which said at least one heat-sealing plate faces and is proximate to said at least one lateral abutment band of said conveyance line, and an active configuration, in which a surface thereof, kept at a predefined temperature, is kept by force against said at least one lateral abutment band, with interposition of said at least one tubular portion which was previously folded by said folding station and partially heat-sealed by means of said at least one heat-sealing block.

9. A plant for covering products by means of packaging sheets, the plant comprising:

a conveyance line for said products and at least one supply line of said sheets, said conveyance line being operated on by an apparatus for wrapping and closing at least one sheet in a tube on each product, and further comprising, downstream of said apparatus, at least one assembly according to claim 1 for folding and heat-sealing at least one tubular portion which is constituted by flaps of packaging sheets which protrude with respect to opposite fronts of the product.

* * * * *